US012221771B2

(12) United States Patent
Patil et al.

(10) Patent No.: US 12,221,771 B2
(45) Date of Patent: Feb. 11, 2025

(54) ON-IMPLEMENT INDICATOR

(71) Applicant: Deere & Company, Moline, IL (US)

(72) Inventors: Aniruddha Patil, Pune (IN); Giovanni A. Wuisan, Epworth, IA (US); Surya Pratap Ponnana, Visakhapatnam (IN); Christopher B. Howard, Dubuque, IA (US)

(73) Assignee: Deere &Company, Moline, IL (US)

( * ) Notice: Subject to any disclaimer, the term of this patent is extended or adjusted under 35 U.S.C. 154(b) by 582 days.

(21) Appl. No.: 17/235,100

(22) Filed: Apr. 20, 2021

(65) Prior Publication Data

US 2022/0333353 A1 Oct. 20, 2022

(51) Int. Cl.
*E02F 9/26* (2006.01)
*E02F 3/40* (2006.01)

(52) U.S. Cl.
CPC . *E02F 9/26* (2013.01); *E02F 3/40* (2013.01)

(58) Field of Classification Search
CPC ..... E02F 9/26; E02F 3/40
See application file for complete search history.

(56) References Cited

U.S. PATENT DOCUMENTS 4,884,939 A * 12/1989 Nielsen ..... E02F 3/435 901/47
2003/0006048 A1* 1/2003 Marriott, Jr. ..... E02F 3/842 701/50
2011/0169949 A1* 7/2011 McCain ..... E02F 3/847 348/148

OTHER PUBLICATIONS

"Micro Bright™ LED Beacon Light," INNOTEC [online], Retrieved on Sep. 17, 2024, 8 pages, Retrieved from Internet: <https://www.innotecgroup.com/led-beacon-light/>.

* cited by examiner

*Primary Examiner* — Curtis B Odom
(74) *Attorney, Agent, or Firm* — Tucker Ellis LLP; Evan T. Perry

(57) ABSTRACT

An indicator positioned in proximity to an implement coupled to equipment is provided. The indicator provides a visual output to an operator of the equipment. The visual output indicates a status of the equipment.

20 Claims, 8 Drawing Sheets

ON-IMPLEMENT INDICATOR

BACKGROUND

Heavy equipment, such as excavators or dozers, are regularly utilized for earthworks. For example, one operation carried out by such construction equipment is a grading operation whereby a level base, or a base with a specific slope, is formed. Grading may be a step in a larger project such as a foundation, roadway, drainage system, and/or landscaping. Grading may be performed by manual operation of equipment. However, even manually executed grading may benefit from a GPS-enabled system to orient the equipment and/or an implement relative to plan. GPS-enabled systems further monitor the position of the implement relative to a planned grade and can provide information output via an indicator showing the implement is above-grade, at-grade, or below-grade and, in some embodiment, may show the extent by which the implement is above or below grade.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In one implementation, a system is provided that includes an indicator positioned in proximity to an implement coupled to a vehicle. The indicator provides a visual output to an operator of the vehicle. The visual output indicates information related to a status of the vehicle.

In another implementation, a system is provide that includes an implement coupled to a vehicle and positioned within a focal distance range relative to an operator in a cab of vehicle. In addition, the system includes an indicator mounted in proximity to the implement and positioned within the focal distance range. The indicator provides a visual output to the operator indicative of a status of the vehicle.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

Various non-limiting embodiments are further described in the detailed description given below with reference to the accompanying drawings, which are incorporated in and constitute a part of the specification.

DETAILED DESCRIPTION

Figure 1:
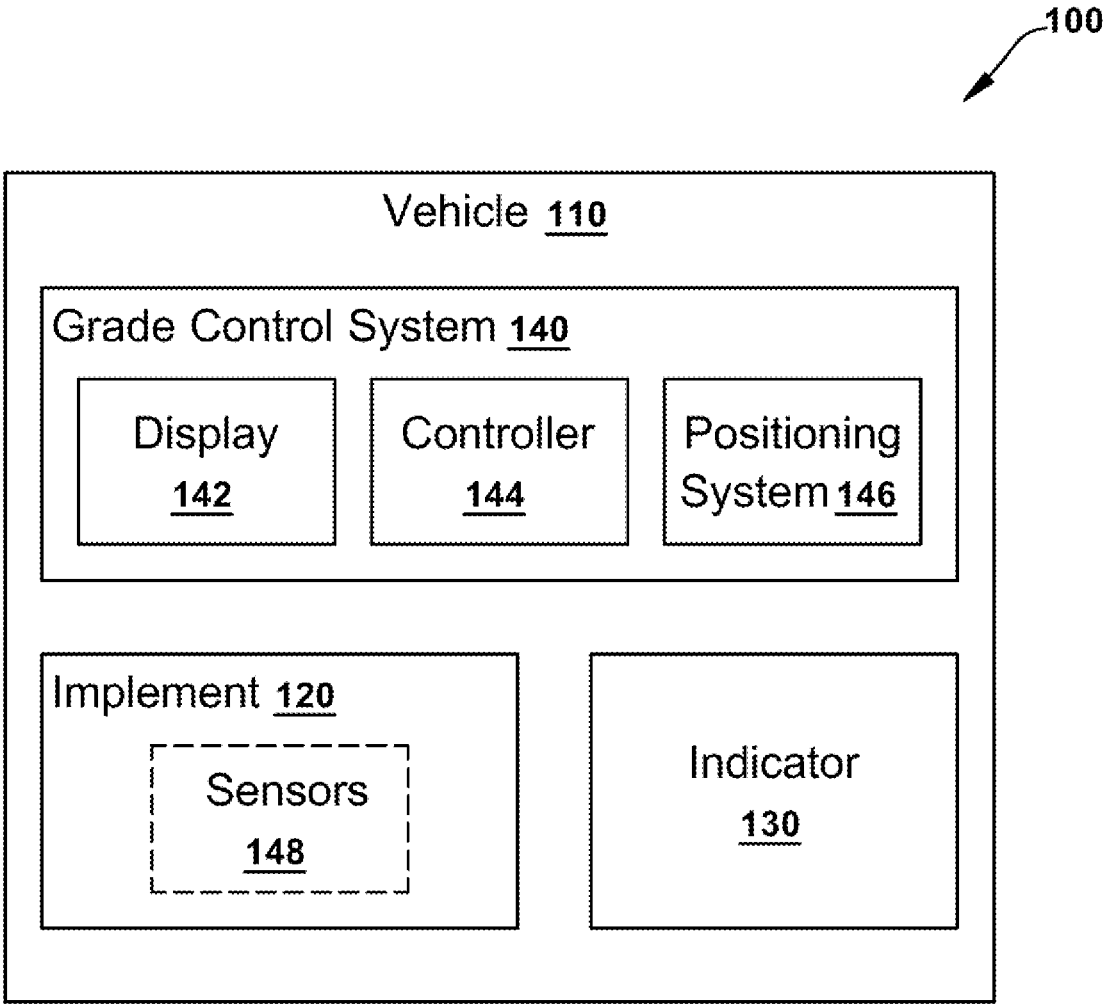
FIG. 1 illustrates an exemplary, non-limiting embodiment of a vehicle according to various aspects.

As described above, a GPS-enabled grade control system facilitates grading with equipment according to a predetermined plan. Such system may be fully automated or allow for manual operation of the equipment. The system may include a display, which is typically positioned within a cab of the equipment. The display, in some examples, may output the plan to assist the operator. Further, the system may also include a grade indicator, or such indication may also be shown in the display. The grade indicator may show a position of an implement (e.g. excavator and/or dozer blade) relative to a planned grade. The indicator, in some examples, may be a series of discrete lights or an LCD outputting a bar. The lights and/or bar may generally be configured such that a center position indicates at-grade, one side of the center position indicates below grade to a degree proportional to a distance from center, and another side of the center position indicates above grade also to a degree in proportion to a distance from center. In conventional set-ups, an operator must shift focus away from the implement to view the display and/or indicator. While having potential to lead to unsafe conditions, repetitive shifting of focus can also fatigue an operator over long durations.

In accordance with various embodiment, a grade-level indicator for used with a GPS-enabled grading system is provided. The grade-level indicator is positioned on or in proximity to an implement employed in grading. Thus, the indicator is positioned to be in a line of sight of an operator observing the implement and also at a similar focal distance as the implement. Such positioning allows the operator to more safely view the indicator while also reducing fatigue.

It is to be appreciated that other information, beyond grade-level information, may also be presented to an operator via in-cab indicators or displays and this information is also relevant while performing an operation with the equipment. Accordingly, the operator may suffer increased fatigue from repetitively shifting focus during the operation in order to perceive this information, just like with the grade-level information described above. While the examples and embodiments described below involve grade-level information, it is to be appreciated that the on-implement indicator disclosed herein can convey other information such as proximity to a boundary (e.g. physical or virtual (i.e. a virtual fence)), swing assist information, machine stability information. To this end, the indicator can signal more than, for example, below, on, or above grade. The indicator may also be utilized to signal far away, close, or at a boundary; that the equipment is stable; nearing tip-over, or danger; or substantially any other information that may change during the operation as a result of the operator's and/or equipment's actions. By presenting such information at a similar focal distance as the implement, the operator can perceive the information during the operation without excess fatigue and/or without shifting focus away from the implement.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Referring briefly to FIG. 1, an exemplary, non-limiting embodiment of a system 100 providing an improved indicator arrangement is provided. As shown in FIG. 1, system 100 may be implemented in a vehicle 110, which may be heavy equipment such as an excavator, bulldozer, or other construction equipment suitable for earth-moving operations that may benefit from having a grade indicator. The vehicle 110 includes an implement 120 such as, but not limited to, an excavator bucket or a dozer blade.

Vehicle 110 may also include a grade control system 140 to facilitate grading with implement 120 according to a plan. The grade control system 140 includes a display 142 for displaying the plan and other information, a controller 144 configured output information to display 142 and for carrying out the functionality of the grade control system 100, and a positioning system 146. In an embodiment, the display 142 may be an LCD, LED, OLED, CRT, or other suitable display. The controller 144 may include a microcontroller, a system-on-a-chip, a FPGA, or other logic circuitry. For instance, controller 110 may include a processor, a computer memory (e.g. a non-transitory computer-readable storage medium), and interfaces to acquire inputs and send signals to various components of system 100 and/or grade control system 144. The memory may include computer-executable instructions that configure the processor to carry out the functions of controller 144 in system 100 and/or grade control system 144. The positioning system 146 may include a global navigation satellite system (GNSS) receiver to determine a position of vehicle 110. In other embodiments, the positioning system 146 may utilize a local positioning such as via cell base stations, Wi-Fi access points, or other radio broadcast sources.

According to one embodiment, sensors 148 may be associated with implement 120 to track a position or movement thereof. For instance, sensors 148 may be accelerometers or other such devices. A pre-determined relationship between a vehicle position provided by positioning system 146 and a location of implement 120 may be configured in grade control system 140. Accordingly, based on data from sensors 148 indicative of a relative position and movement of implement 120 and the vehicle position, a global position of the implement 120 may be determined by controller 144. Sensors 148 may also enable tracking of tilt or rotation of the implement 120. Accordingly, the position and orientation of implement 120 with respect to a planned grade can be determined.

System 100 may also include an indicator 130, which may be a grade-level indicator as described above. Based on a predetermined plan, a position of vehicle 110, and a position and/or orientation of implement 120, controller 144 can output, via indicator 130, a visual indication of a placement implement 120 relative to a planned grade.

Figure 2:
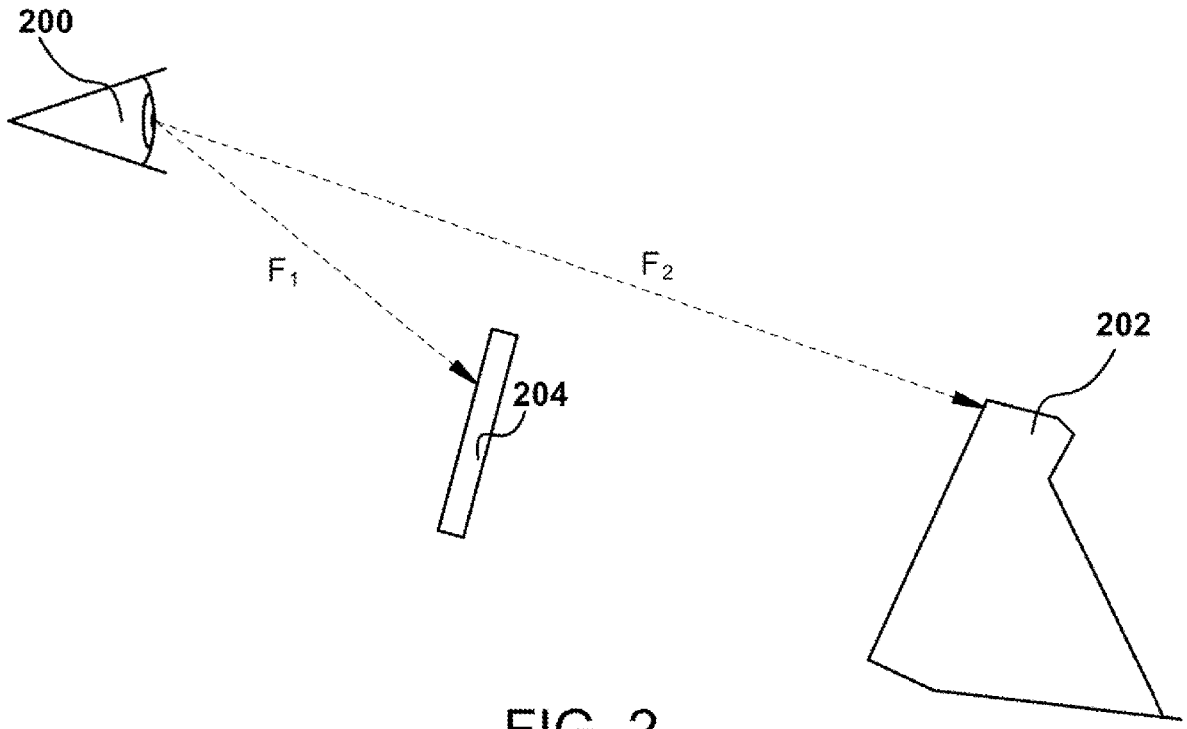
FIG. 2 illustrates different focus distances related to various aspects described herein.

Referring to FIG. 2, an in-cab display 204 may be positioned at a first focal distance F1 from an operator's eye 200 and an implement 202 may be positioned at a second focal distance F2. In some examples, the first focal distance may be equal to or less than 1 meter, and the second focal distance may be approximately 3 to 5 meters. Due to this difference, peripheral vision may inadequately perceive information on display 204 while the operator is concentrating on implement 202. Thus, even if display 204 is within a line of sight while the operator is observing implement 202, the operator may have a difficult time noticing information on display 202. In order to view display 204, accommodation is needed. Accommodation is a process whereby muscles in eye 200 alter a shape of the eye's lens, which changes a focal distance. Repetitive use of these muscles may lead to fatigue.

In conventional configurations of system similar to system 100, indicator 130 may be located near or integrated with display 142. In another example, indicator 130 may be displayed on display 142.

Figure 3:
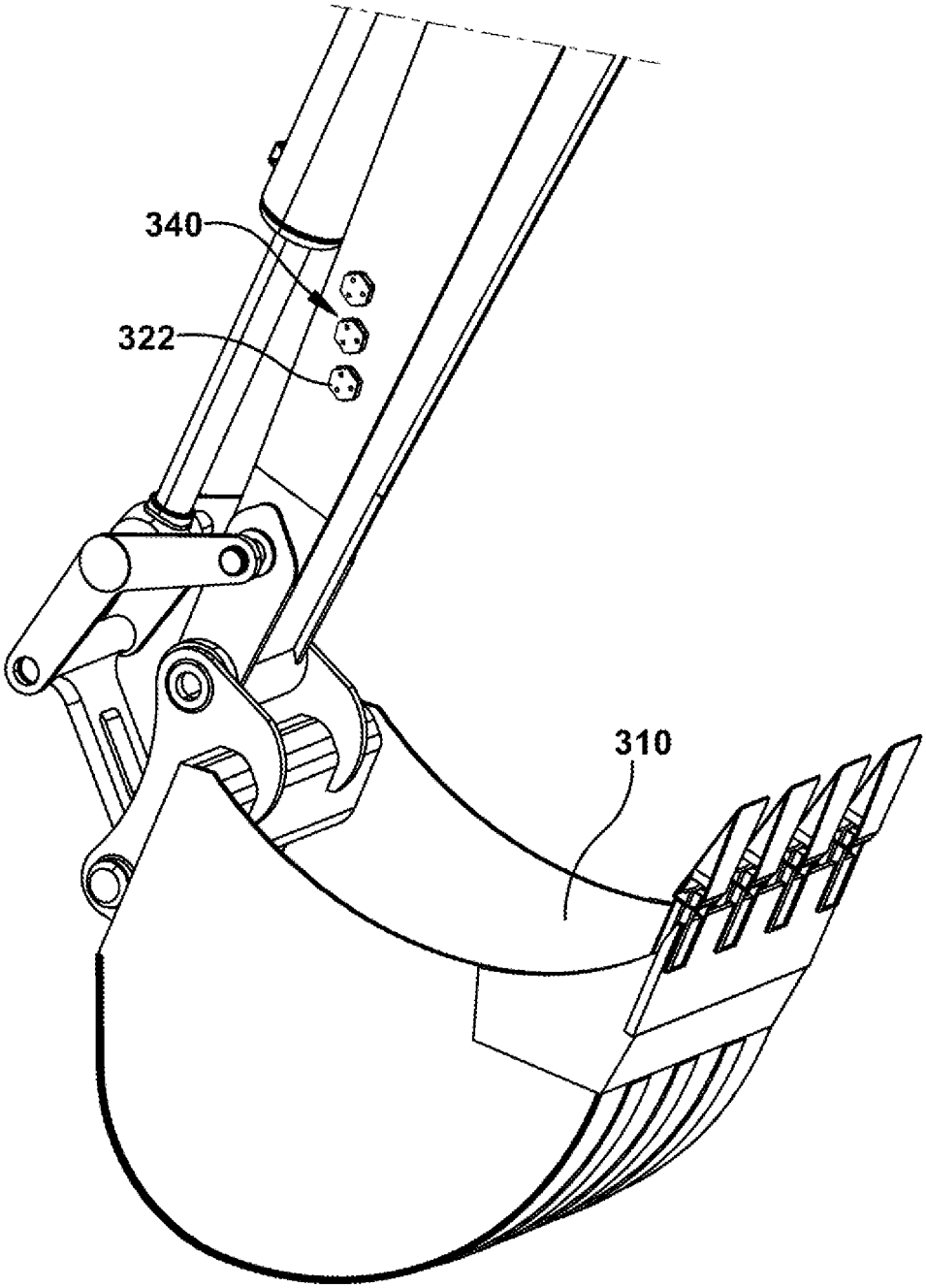
FIG. 3 illustrates an exemplary, non-limiting embodiment of an indicator in proximity to an implement according to an aspect.

Turning to FIG. 3, an exemplary, non-limiting embodiment of an indicator 320 is depicted. As shown in FIG. 3, the indicator 320 includes a plurality or array of indicator elements or device 322 and is positioned in proximity to an implement 310 (e.g. an excavator bucket). In the embodiment shown in FIG. 3, the indicator 320 is attached to a linkage that couples implement 310 to the vehicle. In FIG. 3, indicator 320 includes an array of three elements or beacons. Accordingly, indicator 320 may signal below-grade, at-grade, or above-grade.

Figure 4:
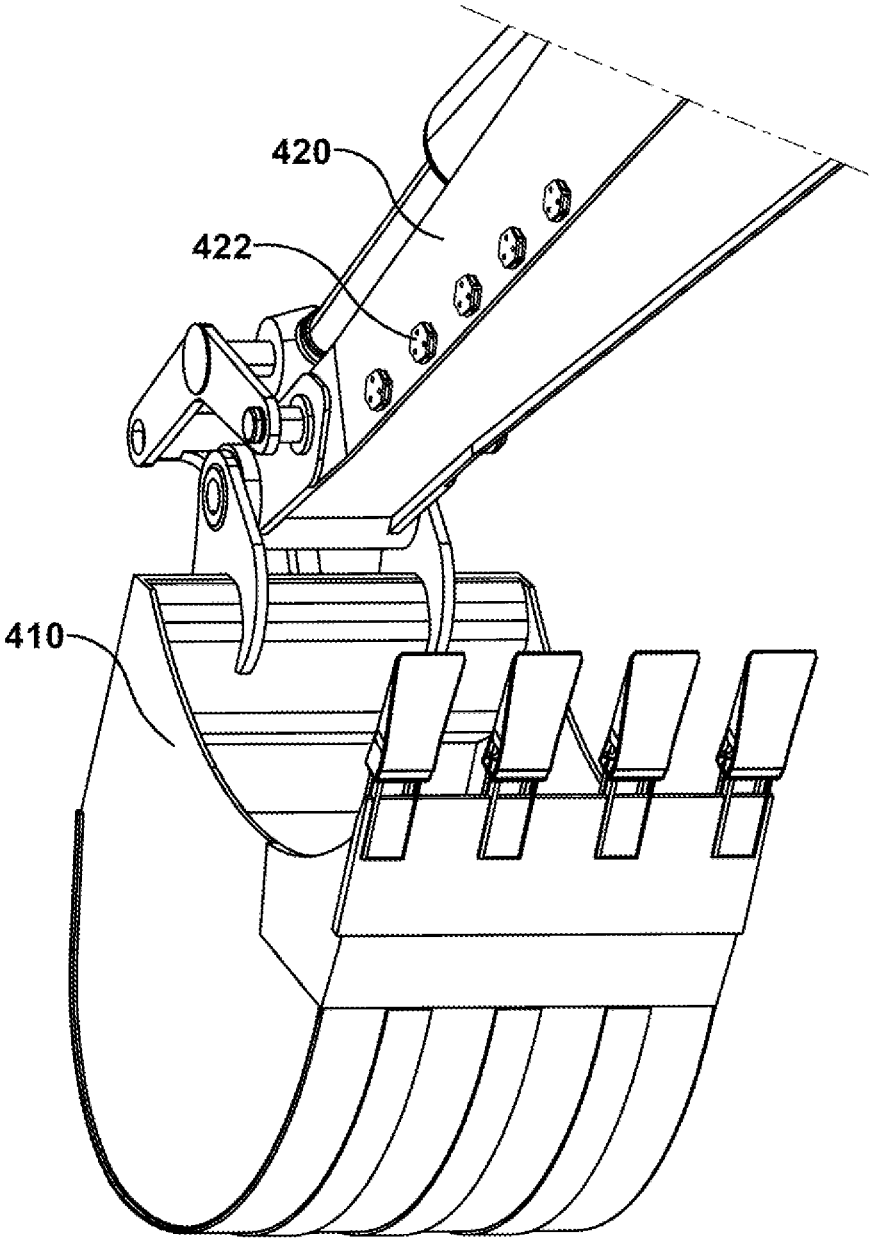
FIG. 4 illustrates an exemplary, non-limiting embodiment of an indicator in proximity to an implement according to an aspect.

FIG. 4 depicts another embodiment of an indicator 420, which also includes an array of indicator elements 422 and is positioned in proximity to implement 410. Indicator 420 includes 5 indicator elements. Accordingly, indicator 420 can signal at-grade, below-grade by a first degree, below-grade by a second degree greater than the first degree, above-grade by a first degree, and above-grade by a second degree greater than the first degree.

The embodiment of FIG. 3 depicts an array of three indicator elements and the embodiment of FIG. 4 depicts an array of five elements. It is to be appreciated, however, that indicators described herein may be implemented by arrays of elements of substantially any number provided sufficient physical space is available in proximity to an implement to output a grade indicator to an operator concentrating on the implement.

Figure 5:
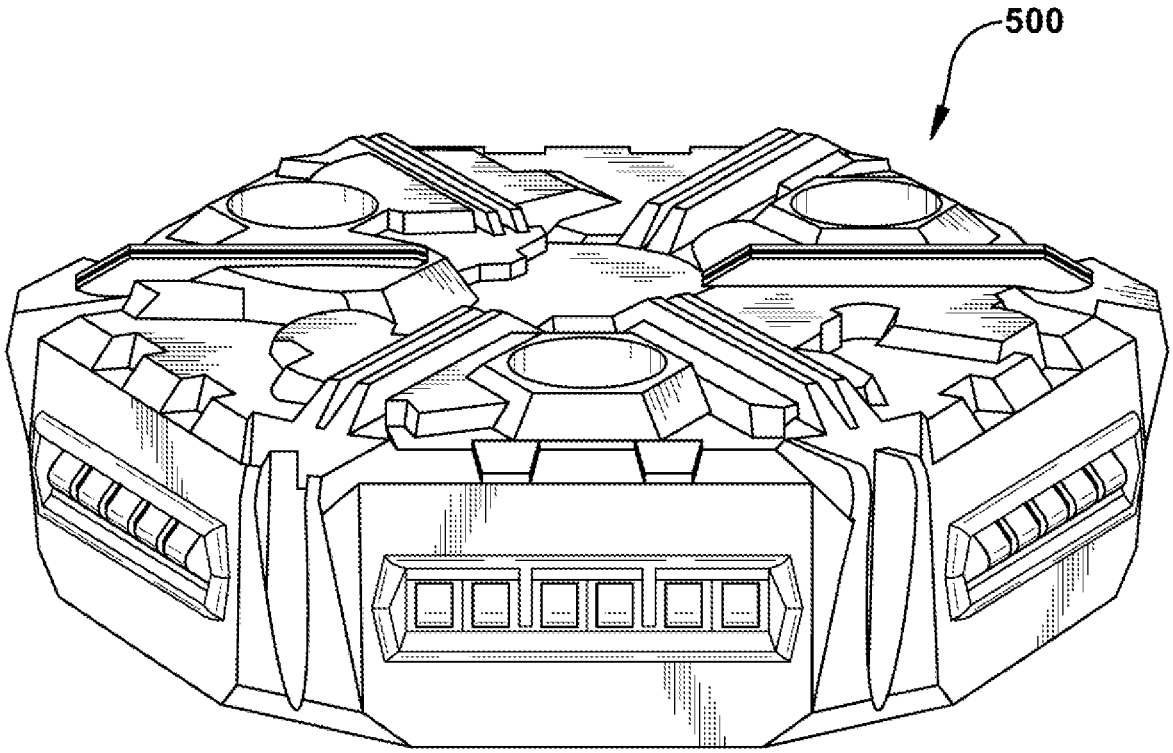
FIG. 5 illustrates an exemplary, non-limiting embodiment of a beacon device suitable for use in implementing an indicator in accordance with various aspects herein.

FIG. 5 illustrates an exemplary, non-limiting embodiment of an indicator element 500. Element 500 is a LED device having a plurality of LEDs situated around a perimeter of the element 500 as shown in FIG. 5. The arrangement of LEDs facilitates viewing of the indicator element's output at a variety of viewing angles.

Figure 6:
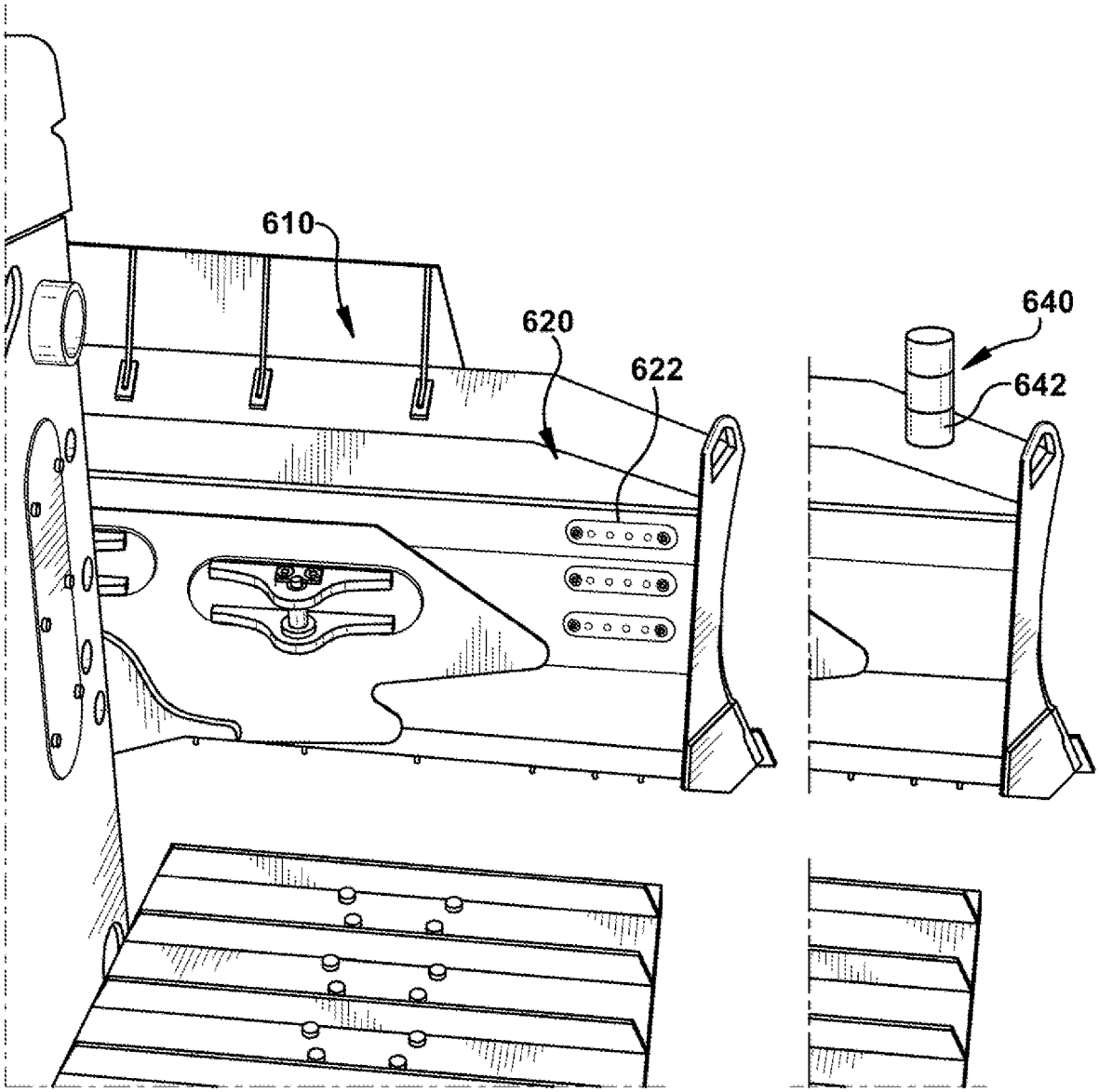
FIG. 6 illustrates further exemplary, non-limiting embodiments of indicators in proximity to an implement.
Figure 7:
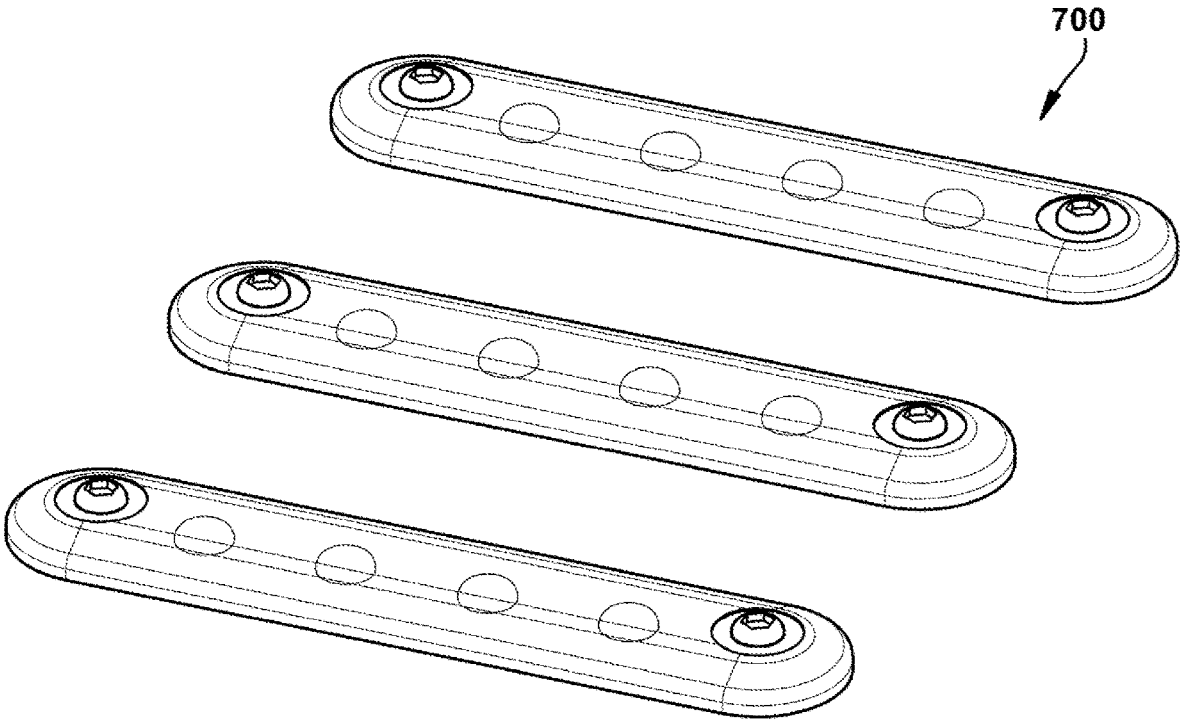
FIG. 7 illustrates an exemplary, non-limiting embodiment of an indicator element suitable for use in implementing an indicator in accordance with various aspects herein.

Turning to FIG. 6, another exemplary, non-limiting embodiment of an indicators are illustrated. The embodiments of FIG. 6 may be associated with a blade 610 of a dozer, for example. In one example, an indicator 620 may include a plurality of indicator elements 622 positioned on a posterior surface of the dozer blade 610. The indicator elements 622 may be LED strips 700 as shown in FIG. 7. In another example, an indicator 640 may be provided on a top portion of the dozer blade 610. In indicator 640 may be a stack light having a plurality of lights to indicator a grade level.

Figure 8:
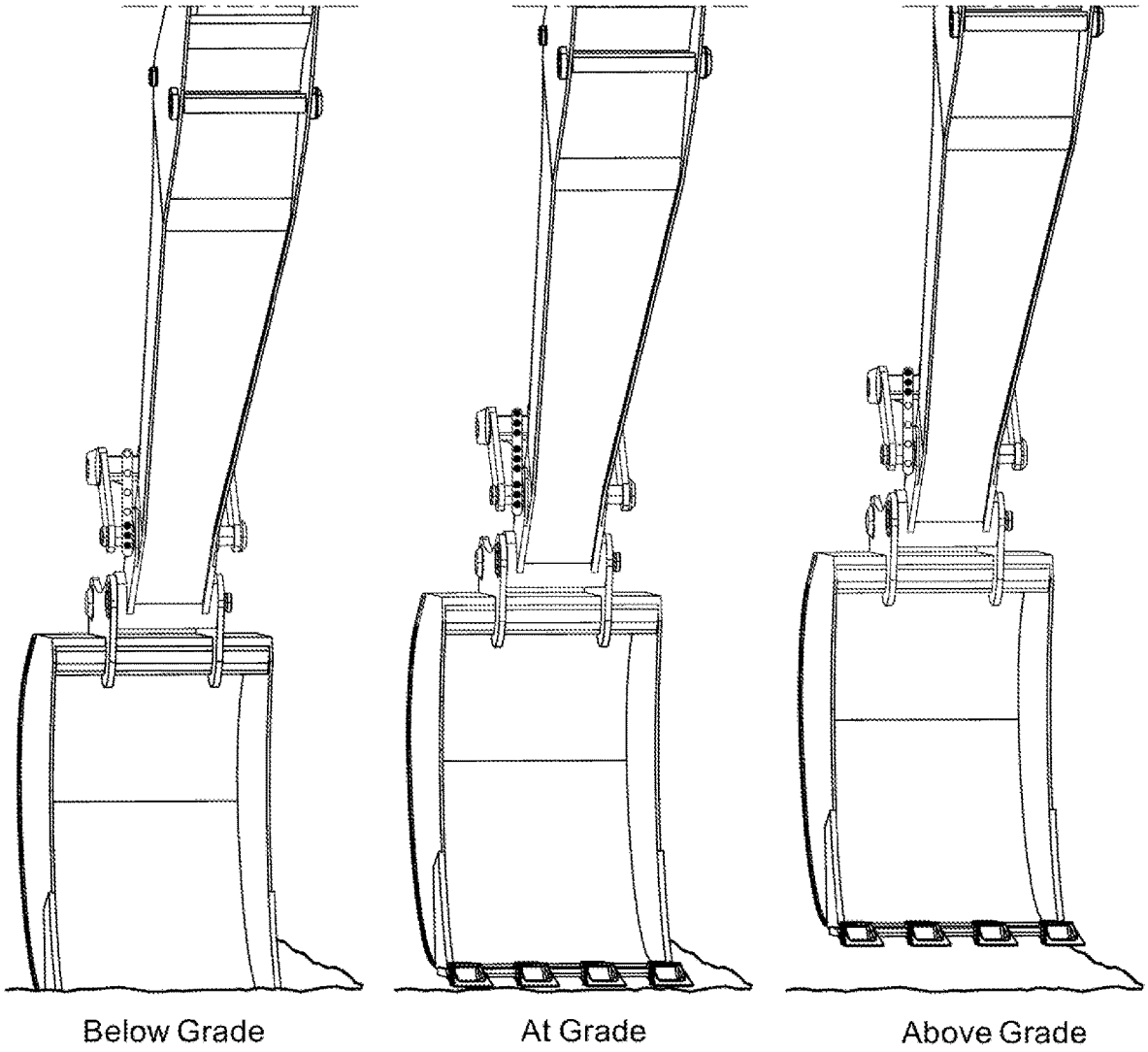
FIG. 8 illustrates an exemplary, non-limiting embodiment of an indictor positioned in proximity to an implement and showing visual output according to a positon of the implement.

Referring to FIG. 8, depicted in an indicator positioned in proximity to an implement during a grading operation. FIG. 8 shows the indicator output when the implement is below grade, at-grade, and above-grade. It is to be appreciated that the example shown in FIG. 8 is non-limiting and the specific form of visual output for the grade indication may be dependent on the type, number, and arrangement of indicator elements utilized to implement the indicator.

While the above examples and embodiments describe the indicator in the context of grade-level information, other applications for the indicator are contemplated herein. As noted previously, the indicator described herein may provide a visual output indicative of substantially any status of a vehicle, machine, or equipment including, but not limited to, proximity to a boundary (e.g. physical or virtual, swing assist information, machine stability information, etc.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

The invention claimed is:

1. A system, comprising:

an indicator positioned in proximity to an implement coupled to a vehicle, wherein the indicator receives a signal from a controller and provides a visual output to an operator of the vehicle based on the signal, the visual output indicates a position of the implement relative to a configured grade.

2. The system of claim 1, wherein the indicator is an array of indicator elements.

3. The system of claim 2, wherein each indicator element is an LED device.

4. The system of claim 3, wherein the LED device is beacon having a plurality of LEDs.

5. The system of claim 3, wherein the LED device is a light strip of LEDs.

6. The system of claim 2, wherein the array includes at least three indicator elements.

7. The system of claim 1, wherein the indicator is a stack light having at least three segments.

8. The system of claim 1, wherein the indicator is positioned in a low-wear area of the implement.

9. The system of claim 1, wherein the indicator receives the signal from a grade control system of the vehicle.

10. The system of claim 1, wherein the indicator is positioned at a focal distance from the operator similar to a focal distance of the implement.

11. The system of claim 1, wherein the configured grade is determined based on a position of the vehicle and a plan.

12. A system, comprising:

an implement coupled to a vehicle and positioned within a focal distance range relative to an operator in a cab of vehicle; and an indicator mounted in proximity to the implement and positioned within the focal distance range, wherein the indicator receives a signal from a controller and provides a visual output to the operator indicative of a position of the implement relative to a configured grade.

13. The system of claim 12, further comprising a grade control system configured to determine a position of the implement with respect to a plan, wherein the signal received by the indicator is from the grade control system, and wherein the configured grade is specified by the plan.

14. The system of claim 12, wherein the implement is an excavator bucket, and wherein the indicator is mounted on an arm proximate to where the excavator bucket is coupled.

15. The system of claim 14, wherein the indicator is an array of LED devices, the array of LED devices being linearly arranged along a longitudinal direction of the arm.

16. The system of claim 12, wherein the implement is a bulldozer blade; and wherein the indicator is mounted on a posterior side of the bulldozer blade.

17. The system of claim 16, wherein the indicator is an array of LED strips.

18. The system of claim 16, wherein the indicator is a stack light positioned at a top portion of the bulldozer blade.

19. The system of claim 12, wherein the indicator provides visual output configured to indicate at least three positions.

20. The system of claim 19, wherein the at least three positions include below grade, on-grade, and above grade when the visual output is indicative of a position of the implement relative to a configured grade.

* * * * *